US009309584B2

(12) United States Patent
Song et al.

(10) Patent No.: US 9,309,584 B2
(45) Date of Patent: Apr. 12, 2016

(54) BASE MATERIAL FOR HIGH TEMPERATURE ALLOY AND MANUFACTURE METHOD THEREOF

(71) Applicant: NINGXIA ORIENT TANTALUM INDUSTRY CO., LTD., Shizuishan, Ningxia (CN)

(72) Inventors: Xiaoying Song, Shizuishan (CN); Quanxin Nie, Shizuishan (CN); Xun Liang, Shizuishan (CN); Weiping Xie, Shizuishan (CN); Zhangjun Bai, Shizuishan (CN); Bing Zhao, Shizuishan (CN); Mingyang Li, Shizuishan (CH); Dong Mu, Shizuishan (CN); Li Wang, Shizuishan (CN); Peng Wan, Shizuishan (CN)

(73) Assignee: NINGXIA ORIENT TANTALUM INDUSTRY CO., LTD., Shizuishan, Ningxia (CN)

( * ) Notice: Subject to any disclaimer, the term of this patent is extended or adjusted under 35 U.S.C. 154(b) by 0 days.

(21) Appl. No.: 14/157,178

(22) Filed: Jan. 16, 2014

(65) Prior Publication Data

US 2014/0224446 A1 Aug. 14, 2014

(30) Foreign Application Priority Data

Jan. 22, 2013 (CN) ..... 2013 1 0021236

(51) Int. Cl.

| | |
|---|---|
| ***C22C 27/06*** | (2006.01) |
| ***C22C 30/00*** | (2006.01) |
| ***C22C 38/00*** | (2006.01) |
| *B22D 7/00* | (2006.01) |

(52) U.S. Cl.

CPC ..... *C22C 27/06* (2013.01); *C22C 30/00* (2013.01); *C22C 38/00* (2013.01); *B22D 7/00* (2013.01)

(58) Field of Classification Search

CPC ..... C22C 27/06; C22C 30/00; B22D 27/15; B22D 11/113; B22D 7/00

USPC ..... 164/493, 47; 420/583, 34, 71

See application file for complete search history.

(56) References Cited

FOREIGN PATENT DOCUMENTS

| | | | |
|---|---|---|---|
| CN | 1636075 | | 7/2005 |
| CN | 101311277 | | 11/2008 |
| CN | 101586202 | | 11/2009 |
| JP | 55-122847 | | 9/1980 |
| JP | 2002146484 A | * | 5/2002 |
| WO | WO 03/060174 | | 7/2003 |

OTHER PUBLICATIONS

English Machine Translation of Kariya et al. JP-2002-146484.*

Chinese Office Action dated May 16, 2014 for Appln. No. 201310021236.5.

Chinese Office Action dated May 16, 2014 for Appln. No. 201310021236.9.

* cited by examiner

*Primary Examiner* — Kevin P Kerns

*Assistant Examiner* — Steven Ha

(74) *Attorney, Agent, or Firm* — Pillsbury Winthrop Shaw Pittman, LLP

(57) ABSTRACT

The present invention relates to a base material for high temperature alloy and a process for manufacturing the same. The base material includes following components (by weight): 10-45% Cr, 0.5-12% Nb, 0.7-2.5% Ti, ≤9.0% Mo, ≤8.0% W, ≤2% Mn, ≤1.0% Si, ≤2.0% Al, ≤0.5% C, ≤0.032% O, ≤0.032% N,≤0.01% S, ≤0.02% P, and balance being Fe and unavoidable impurities. The process for manufacturing the base material for high temperature alloy includes following steps: providing raw materials according to the target composition; charging the raw materials in a crucible uniformly layer and layer according to a certain sequence, smelting in vacuum condition; after the materials being melted completely, holding the melt at a temperature; and casting ingot, and cooling to obtain a base material for high temperature alloy.

12 Claims, No Drawings

BASE MATERIAL FOR HIGH TEMPERATURE ALLOY AND MANUFACTURE METHOD THEREOF

CROSS REFERENCE TO RELATED APPLICATIONS

This application is based upon and claims the benefit of priority from Chinese Patent Application 201310021236.9, filed Jan. 22, 2013, the entire contents of which are incorporated herein by reference.

TECHNICAL FIELD

The present invention relates to the field of high temperature alloys, and particularly to a base material for high temperature alloy and manufacture method thereof. The base material is especially suitable for the production of nickel-based alloys for aerospace, nuclear power, petroleum industry and extrusion die at a temperature in the range of −253° C. to 1000° C.

BACKGROUND ART

High temperature alloys mean a class of metal materials which can work at a high temperature of above 600° C. and at a certain stress for a long-term. High temperature alloys generally include iron-based high temperature alloys, nickel-based high temperature alloys, cobalt-based high temperature alloys, etc. High temperature alloys have relatively high strength at a high temperature, good resistance to oxidation and thermal corrosion, excellent fatigue performance, fracture toughness, plasticity, and other properties. High temperature alloys also have good structure stability and application reliability at various temperatures. On the basis of above properties and characteristics, high temperature alloys exhibit a high alloying extent, and thus are also called as Superalloys.

High temperature alloys have been used in many industrial field, such as large aircraft engineer—as materials of components at hot end of aircraft engine; Industrial gas turbine—as materials for hot end components; nuclear power technology—as tubes of high temperature alloys; other civil industries -metallurgies, petrochemistries, transportations, and energy sources, etc.; aircraft engines—as high strength high temperature alloys; aerospace engines—as short-term ultra-high temperature high strength high temperature alloys; marine engines—as high temperature alloys having corrosion resistance and long life.

High temperature alloys generally consist of a plurality of alloying elements, and all the alloying elements such as Ni, Mo, Nb, Cr, etc. required for the manufacture of high temperature alloys at present are substantially pure elemental substances. However, in the domestic and international markets, due to the high prices of pure metals, the manufacture cost of high temperature alloys is relatively high. However, as to specific products, metallic raw materials with high purities are unnecessary. Since there are not raw materials with proper quality in the market, downstream enterprises have to purchase "over-qualified" raw materials, the cost for raw materials is increased. If a specific base alloy material, which is not elemental substance, is produced according to specific alloy products, then the purchase cost will be reduced greatly. For producers of raw materials, the production costs will also be reduced remarkably and thereby the market competitiveness will be improved.

At present, high temperature alloys and the base material thereof are melted in electric arc furnace, vacuum induction furnace, or by electroslag remelting, or a combination thereof. These melting apparatus and methods are main melting forms employed in the world. Hence, it is desired to remarkably reduce the production cost of high temperature alloys and not increase the apparatus investment, and at the meanwhile ensure the uniformity of the alloy components. Moreover, the high temperature alloys produce by utilizing such base material achieve equivalent or better properties as compared to the same class of alloys.

SUMMARY OF THE INVENTION

An object of the present invention is to change the existing melting methods of high temperature alloys; the problem to be solved by present invention is to provide a base material (or parent material) for high temperature alloy with relatively low production cost. The base material has the advantages of homogeneous composition and lower production cost. The base material is suitable for smelting various kinds of high temperatures alloys.

The base material for high temperature alloy according to the present invention have following chemical composition (by weight %): 10-45% Cr, 0.5-12% Nb, 0.7-2.5% Ti, ≤9.0% Mo, ≤8.0% W, ≤2% Mn, ≤1.0% Si, ≤2.0% Al, ≤0.5% C, ≤0.032% O, ≤0.032% N, ≤0.01% S, ≤0.02% P, and balance being Fe and unavoidable impurities.

In a preferred embodiment of the present invention, the Cr content in the base material for high temperature alloy is 30-45%.

In a preferred embodiment of the present invention, the Nb content in the base material for high temperature alloy is 2-12%.

In a preferred embodiment of the present invention, the Ti content in the base material for high temperature alloy is 1.0-2.5%.

The advantages of the present invention are: using the base material as a raw material can effectively manufacture qualified substrates of high temperature alloys, and the substrates have good anti-fatigue, anti-radiation, anti-oxidation and corrosion resistance properties. Additionally, the substrates have good processing and welding performances, and can be manufactured into parts or components with various complex shapes. Since the use of the base material of alloys according to the present invention can avoid the use of expensive pure metals raw materials, the consumption of energy resources is reduced and the production cost is deceased.

Nitrogen and oxygen have relatively large solubility in the melts of nickel-based, iron-based, or cobalt-based alloys, however they have a very low solubility in solidified state alloys. Moreover, after the solidification of alloys, nitrogen and oxygen present in the alloys in form of gases will be very harmful. Therefore, the content of nitrogen and oxygen in the base material of alloys according the present invention must be controlled strictly. Typically, in the base material of alloys according to the present invention, the content of nitrogen and oxygen is preferably controlled as: O≤0.032%, N≤0.032%.

The impurities such as P, S, etc. are very harmful to the high temperature properties of alloys due to severe segregation and grain boundary, and thus should be controlled in a level as low as possible. Typically, in the base material of alloys according to present invention, the contents of S and P are preferably controlled as: S≤0.01%, P≤0.02%.

The melting process of the base material of alloys according to the present invention is as follows: various intermediate alloys are used as raw materials, such as ferrochromium, ferroniobium, molybdenum bars (or ferromolybdenum), ferrotungsten, titanium blocks (titanium chips or titanium scraps), pure iron having low carbon content; the raw materials are combined appropriately and charged in a crucible uniformly layer by layer according to following sequence: Fe→NbFe→CrFe→MoFe and/or WFe→Fe→CrFe→Ti→NbFe→CrFe; smelting in a vacuum medium-frequency induction furnace, and harmful impurities are removed by vacuum degassing method according to the amount of impurities in the raw materials. The ratio between the Fe feedstock added in two times is 1:1, the ratio between the NbFe feedstock added in two times is 1:1.5, and the ratio of the CrFe added in three times is 1:1.5:1. The vacuum degree should be controlled above $10^{-2}$ Pa before carrying out the vacuum smelting; after the materials are melted completely, the temperature is hold for 30-60 minutes; then ingots are cast and cooled to obtain a base material for high temperature alloy.

The present invention has following advantages over the prior art: intermediate alloys, such as ferroniobium, ferrochromium, instead of pure metals are used to smelt the base material for high temperature alloy; according to the composition of alloys, different raw materials are selected, combined and charged; thus the production cost is reduced remarkably while the alloy components conform to the standard and the application requirements are met; in particular, the production cost of high temperature alloys can be reduced by 20% or more.

EMBODIMENTS

The present invention will be described by following examples.

EXAMPLE 1

The raw materials of alloy were provided according to the target composition of 40.12Cr-39.66Fe-11.14Nb-6.87Mo-2.14Ti by weight percent; wherein the feedstock of Cr was CrFe having Cr content of 60%, the feedstock of Nb was NbFe having Nb content of 70%, the feedstock of Mo was MoFe having Mo content of 60%, the feedstock of Ti was titanium scraps (without oxide layer on the surface), and the feedstock of Fe was electrical grade pure iron. The raw materials were charged into a smelting crucible of medium-frequency induction furnace uniformly layer by layer according to following sequence: Fe→NbFe→CrFe→MoFe→Fe→CrFe→Ti→NbFe→CrFe; wherein the ratio between the Fe feedstock added in two times was 1:1, the ratio between the NbFe feedstock added in two times was 1:1.5, and the ratio among the CrFe feedstock added in three times was 1:1.5:1. Then the furnace was vacuumed to $5\times10^{-2}$ Pa, heated by electricity; after the materials were melted completely, the temperature was held for 30 minutes; casting and cooling to obtain ingots of base material of alloy having target composition.

Following Table 1 shows the actual composition of the base material of alloys in different batches (batches 1 to 4) obtained in Example 1. It can be seen from Table 1 that the base materials of high temperature alloys obtained by the process of the present invention having a composition which is substantially consistent with the target composition, and the impurities level was controlled well.

EXAMPLE 2

Raw materials were provided according to the target composition of 34.4Cr-56.8Fe-2.4Nb-4.8W-1.6Ti by weight percent; wherein the feedstock of Cr was CrFe having Cr content of 60%, the feedstock of Nb was NbFe having Nb content of 70%, the feedstock of W was WFe having W content of 60%, the feedstock of Ti was titanium scraps, and the feedstock of Fe was electrical grade pure iron. The raw materials were charged in a smelting crucible of medium-frequency induction furnace uniformly layer by layer according to following sequence:

Fe→NbFe→CrFe→WFe→CrFe→Fe→Ti→NbFe→CrFe;

wherein the ratio between the Fe feedstock added in two times was 1:1, the ratio of NbFe feedstock added in two times was 1:1.5, and the ratio among the CrFe feedstock added in three times was 1:1.5:1; and then carrying out the vacuum smelting; after the materials were melted completely, the temperature was held for 30 minutes; followed by casting to obtain ingot of base material of alloy having target composition.

EXAMPLE 3

The base material of alloy manufactured in Example 1 was smelted together with metal nickel at a ratio of 48% to 52%, the smelting was carried out by a duplex process, and the first smelting was vacuum induction smelting. When the furnace was vacuumed to $3\times10^{-2}$ Pa, electricity was turned on to heat the apparatus; after the materials were melted completely, the temperature was held at 1500-1600° C. for 30 minutes, and the melt was cast. The secondary smelting was vacuum consumable arc-smelting; during the smelting, the voltage was 30-36 V, the smelting current was 5-9 KA, and the melting rate was 2-6 Kg/min. The resulting ingot was heated at a temperature of 1100° C., the bars manufactured by forging at above 1000° C. was held at 950-980° C. for 1 hour, air cooled to 720° C., held for 8 hours, furnace-cooled at 50° C./h to 620° C., held for 8 hours, air cooled to room temperature; then the resulting nickel-based high temperature alloy bars were subjected to microstructural analysis and mechanical property testing. The results are shown in Table 2 below. It can be seen from the measurements of the room temperature properties and high temperature properties of the alloys in Table 2 that the alloys have good plasticity, and high tensile and yield strength. This shows that the alloys have excellent properties, and are suitable for processing various heat-resistant parts; and the performance of the alloys is comparable to that smelted with pure metals.

TABLE 1

Chemical composition of base materials for high temperature alloy (wt %)

| | Alloying elements % | | | | | Impurity components % | | | |
|---|---|---|---|---|---|---|---|---|---|
| Items | Cr | Mo | Nb | Fe | Ti | N | O | P | S |
| Target value | 40.12 | 6.87 | 11.14 | Balance | 2.14 | 0.032 | 0.032 | 0.02 | 0.01 |
| Batch 1 | 40.23 | 6.74 | 11.26 | Balance | 2.09 | 0.019 | 0.021 | 0.013 | 0.0087 |
| Batch 2 | 40.16 | 6.81 | 11.17 | Balance | 2.11 | 0.016 | 0.01 | 0.0094 | 0.01 |
| Batch 3 | 40.22 | 6.76 | 11.30 | Balance | 2.05 | 0.0088 | 0.0065 | 0.014 | 0.0093 |
| Batch 4 | 40.09 | 6.88 | 11.08 | Balance | 2.07 | 0.013 | 0.0092 | 0.0086 | 0.0096 |

TABLE 2 the grain structure and mechanical property of high temperature alloys

| | | Tensile at room temperature | | | Tesile at 650° C. | | |
|---|---|---|---|---|---|---|---|
| No. | Grain grade ASTM | Tensile strength $\sigma_b$/MPa | Yiled Strength $\sigma_{0.2}$/MPa | (elongation) Ψ/% | Tensile strength $\sigma_b$/MPa | Yiled Strength $\sigma_{0.2}$/MPa | (elongation) Ψ/% |
| 1 | 5 | 1275 | 1035 | 15 | 1000 | 860 | 15 |
| 2 | 6 | 1345 | 1100 | 16 | 1080 | 930 | 15 |
| 3 | 5 | 1280 | 1098 | 15 | 1050 | 900 | 15 |
| 4 | 7 | 1450 | 1240 | 16 | 1170 | 1000 | 15 |

The invention claimed is:

1. A process for manufacturing a base material for high temperature alloy, characterized in that the process comprises following steps:

(1) the raw materials were provided according to the composition of the base material for high temperature alloy, wherein the base material for high temperature alloy has following composition: 10-45% Cr, 0.5-12% Nb, 0.7-2.5% Ti, ≤9.0% Mo, ≤8.0% W, ≤2% Mn, ≤1.0% Si, ≤2.0% Al, ≤0.5% C, ≤0.032% O, ≤0.032% N, ≤0.01% S, ≤0.02% P, and balance being Fe and unavoidable impurities; and wherein the feedstock of Nb, Mo, Cr or W are their intermediate alloys with iron respectively, the feedstock of Ti is titanium chips or titanium scraps, and the feedstock of Fe is pure iron;

(2) the raw materials are charged in a crucible uniformly layer by layer according to following sequence: Fe→NbFe→CrFe→MoFe and/or WFe→Fe-CrFe→Ti→NbFe→CrFe, and smelted in vacuum condition; and (3) the raw materials are melted completely, and the melt is temperature-help for 30-60 minutes, then the melt is subjected to ingot casting, and the base material for high temperature alloy is obtained after cooling.

2. The process according to claim 1, characterized in that the smelting is vacuum medium-frequency smelting.

3. The process according to claim 2, characterized in that the pressure during the vacuum smelting is not higher than $10^{-2}$ Pa.

4. The process according to claim 1, characterized in that the feedstock of niobium is ferroniobium.

5. The process according to claim 1, characterized in that the feedstock of molybdenum is ferromolybdenum.

6. The process according to claim 1, characterized in that the feedstock of chromium is ferrochromium.

7. The process according to claim 1, characterized in that the feedstock of tungsten is ferrotungsten.

8. The process according to claim 1, characterized in that the pure iron is added in two times, the ratio between the two additions is 1:1.

9. The process according to claim 1, characterized in that the ferroniobium iron is added in two times, the ratio between the two additions is 1:1.5.

10. The process according to claim 1, characterized in that the ferrochromium iron is added in two times, the ratio of ferrochromium added in two times is 1:1.5.

11. A process for manufacturing a base material for high temperature alloy, the process comprising the steps of: providing raw materials according to the target composition of 40.12Cr-39.66Fe-11.14Nb-6.87Mo-2.14Ti by weight percent, wherein the feedstock of Cr is CrFe having Cr content of 60%, the feedstock of Nb is NbFe having Nb content of 70%, the feedstock of Mo is MoFe having Mo content of 60%, the feedstock of Ti is titanium scraps, and the feedstock of Fe is electrical grade pure iron; charging the raw materials in a smelting crucible of medium-frequency induction furnace uniformly layer by layer according to following sequence: Fe→NbFe→CrFe→MoFe→Fe→CrFe→Ti→NbFe→CrFe, wherein the ratio between the Fe feedstock added in two times was 1:1, the ratio of NbFe feedstock added in two times was 1:1.5, and the ratio of CrFe added in two times was 1:1.5; subjecting to vacuum melting, after the materials being melted completely, holding the temperature for 30 minutes; subjecting to ingot casting, and cooling to obtain a base material for high temperature alloy.

12. A process for manufacturing a base material for high temperature alloy, the process comprising the steps of: providing raw materials according to the target composition of 34.4Cr-56.8Fe-2.4Nb-4.8W-1.6Ti by weight percent, wherein the feedstock of Cr is CrFe having Cr content of 60%, the feedstock of Nb is NbFe having Nb content of 70%, the feedstock of W is WFe having 60% of W content, the feedstock of Ti is titanium scraps, and the feedstock of Fe is electrical grade pure iron; charging the raw materials in a smelting crucible of medium-frequency induction furnace uniformly layer by layer according to following sequence: Fe→NbFe→CrFe→WFe→CrFe→Fe→Ti→NbFe→CrFe, wherein the ratio between the Fe feedstock added in two times is 1:1, the ratio of NbFe feedstock added in two times is 1:1.5, and the ratio of CrFe added in two times is 1:1.5; subjecting to vacuum smelting; after the materials being melted completely, holding temperature for 30 minutes; subjecting to ingot casting and cooling to obtain a base material for high temperature alloy.

* * * * *